US011293167B2

(12) United States Patent
Cowper et al.

(10) Patent No.: US 11,293,167 B2
(45) Date of Patent: Apr. 5, 2022

(54) IMPLEMENT STALL DETECTION SYSTEM

(71) Applicant: Caterpillar Inc., Peoria, IL (US)

(72) Inventors: Lance Cowper, Metamora, IL (US); Ronald Paul Dettman, Juniper, FL (US); Cody Joshua Ryerson, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 272 days.

(21) Appl. No.: 16/562,079

(22) Filed: Sep. 5, 2019

(65) Prior Publication Data

US 2021/0071389 A1 Mar. 11, 2021

(51) Int. Cl.
*E02F 9/20* (2006.01)
*E02F 9/22* (2006.01)

(52) U.S. Cl.
CPC ..... *E02F 9/2025* (2013.01); *E02F 9/2246* (2013.01)

(58) Field of Classification Search
CPC ..... E02F 9/2025; E02F 9/205; E02F 9/2246; E02F 9/268
See application file for complete search history.

(56) References Cited

U.S. PATENT DOCUMENTS 4,878,042 A 10/1989 Eggiman
5,163,170 A * 11/1992 Grabowski ..... B60L 3/00 318/113
7,508,090 B2 3/2009 Nakashima
2005/0007246 A1 1/2005 Yen et al.
2013/0154823 A1 6/2013 Ostrer et al.
2014/0055894 A1* 2/2014 Maruyama ..... H02H 9/04 361/56
2014/0159888 A1 6/2014 Gauger et al.
2017/0072850 A1 3/2017 Curtis et al.
2018/0066414 A1 3/2018 Voelz
2019/0071067 A1* 3/2019 Leone ..... F02D 41/3005
2019/0322461 A1* 10/2019 Banthia ..... B65G 67/24
2020/0010062 A1* 1/2020 Switkes ..... B60T 7/18
2020/0012003 A1* 1/2020 Mino ..... G01V 1/008

* cited by examiner

*Primary Examiner* — Tyler J Lee
(74) *Attorney, Agent, or Firm* — Harrity & Harrity LLP

(57) ABSTRACT

A work machine is disclosed. The work machine may include a frame, an implement system coupled to the frame, one or more sensing devices, and a control unit in communication with the implement system and the one or more sensing devices. The one or more sensing devices may be configured to transmit sensing device data relating to an operation of the implement system. The control unit may receive the sensing device data, compare the sensing device data with a stall threshold, and initiate a stall timer based on determining that the sensing device data satisfies the stall threshold. The stall timer may be configured to measure a stall duration. The control unit may compare the stall duration with a duration threshold, identify a stall event based on determining that the stall duration satisfies the duration threshold, and cause an action to be performed based on the stall event.

17 Claims, 3 Drawing Sheets

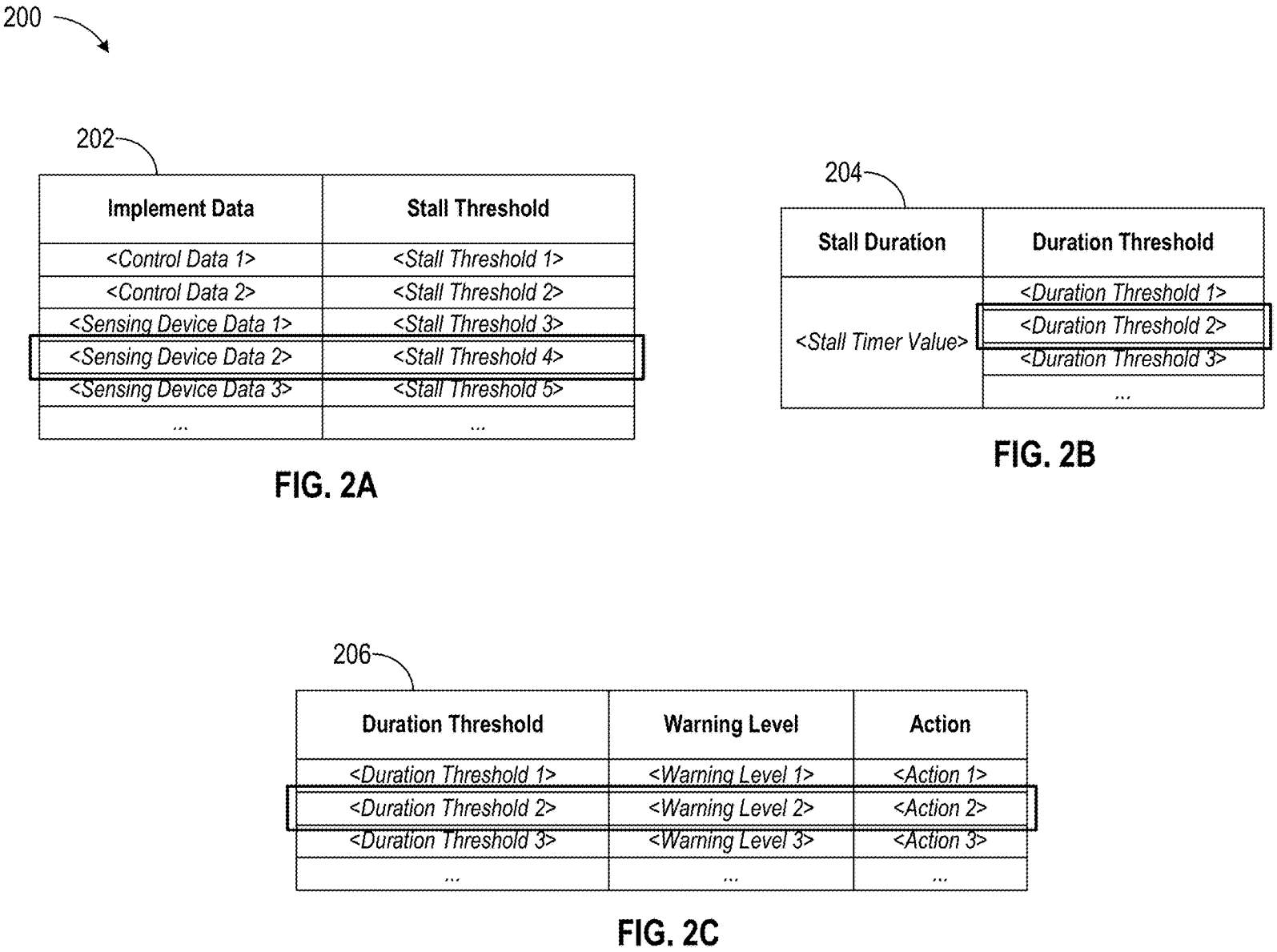
200
202
Implement Data
Stall Threshold
<Control Data 1>
<Stall Threshold 1>
<Control Data 2>
<Stall Threshold 2>
<Sensing Device Data 1>
<Stall Threshold 3>
<Sensing Device Data 2>
<Stall Threshold 4>
<Sensing Device Data 3>
<Stall Threshold 5>
...
FIG. 2A
204
Stall Duration
Duration Threshold
<Stall Timer Value>
<Duration Threshold 1>
<Duration Threshold 2>
<Duration Threshold 3>
...
FIG. 2B
206
Duration Threshold
Warning Level
Action
<Duration Threshold 1>
<Warning Level 1>
<Action 1>
<Duration Threshold 2>
<Warning Level 2>
<Action 2>
<Duration Threshold 3>
<Warning Level 3>
<Action 3>
...
FIG. 2C

IMPLEMENT STALL DETECTION SYSTEM

TECHNICAL FIELD

The present disclosure relates generally to work machines and, for example, to an implement stall detection system for work machines.

BACKGROUND

A work machine (e.g., a dozer, a tractor, a wheel loader, an excavator, and/or the like) may be provided with an implement system. The implement system may include an implement and a drive assembly that may be hydraulically, pneumatically, and/or electrically operated to manipulate the implement. In particular, the implement system may receive one or more input commands indicative of a desired position, movement, and/or action of the implement from an operator, and use the drive assembly to raise, tilt, rotate, and/or otherwise manipulate the implement according to the input commands. In some cases, the implement system may stall, such as when an input command provided by an operator overloads a component of the drive assembly of the implement system or otherwise controls the implement system to a maximum capability of the drive assembly. Prolonged and/or frequent stall events can raise component temperatures, pressures, and/or other operating conditions beyond acceptable thresholds and accelerate wear of the implement system and/or the work machine.

Accordingly, a stall event can cause adverse effects to a work machine and/or an implement system of the work machine. However, a conventional work machine may not be equipped with sufficient safeguards for preventing and/or limiting such stall events. For instance, a typical work machine may be designed to rely solely on an operator of the work machine to avoid prolonged and/or frequent stall events. In some cases, however, an operator may intentionally stall an implement system (e.g., by intentionally forcing a piston against an end stroke of a cylinder and/or otherwise intentionally causing a component of an associated drive assembly to approach a physical limit of the component). For example, an operator may intentionally stall an implement system (e.g., upon a cold start) in order to more quickly raise operating temperatures and/or pressures to desired levels (e.g., in preparation of a calibration routine, a test routine, and/or another operation). Without adequate means to prevent or limit such stall events, conventional work machines are often subjected to premature failure, costly repairs, and/or significant downtime.

One attempt to address a stall event of an industrial machine is disclosed in U.S. Publication No. 2018/0066414, by Voelz, published on Mar. 8, 2018 ("the '414 publication"). The '414 publication discloses a mining machine that includes a boom supporting a pivotable handle and a bucket attachment. In particular, the '414 publication discloses that the mining machine includes a control system, a controller, and sensors, and that the sensors indicate to the controller a level of extension or retraction of the bucket. The '414 publication further discloses that the mining machine is capable of a semi-autonomous mode of operation that enables a user to intervene in the event of a stalling condition. Since the mining machine of the '414 publication relies on manual user control to address a stall event, the mining machine of the '414 publication lacks an ability to provide an alert regarding a stall event or to respond to a stall event in a manner that safeguards the implement system against operator misuse.

An implement stall detection system of the present disclosure solves one or more of the problems set forth above and/or other problems in the art.

SUMMARY

According to some implementations, a method may include receiving, by a device, implement data relating to an implement system of a work machine; comparing, by the device, the implement data with a stall threshold; initiating, by the device, a stall timer based on determining that the implement data satisfies the stall threshold, the stall timer being configured to measure a stall duration; comparing, by the device, the stall duration with a first duration threshold and a second duration threshold, the second duration threshold being longer in duration than the first duration threshold; identifying, by the device, a stall event based on determining that the stall duration satisfies at least one of the first duration threshold or the second duration threshold; and causing, by the device, at least one of a first action or a second action to be performed based on the stall event, the first action being performed based on determining that the stall duration satisfies the first duration threshold and not the second duration threshold, or the second action being performed based on determining that the stall duration satisfies the second duration threshold.

According to some implementations, a device may include one or more memories; and one or more processors, communicatively coupled to the one or more memories, configured to receive sensing device data relating to an implement system of a work machine; receive control data relating to an input command for operating the implement system; compare the sensing device data and the control data with a stall threshold; initiate a stall timer based on determining that one or more of the sensing device data or the control data satisfies the stall threshold, the stall timer being configured to measure a stall duration; compare the stall duration with a duration threshold; identify a stall event based on determining that the stall duration satisfies the duration threshold; and cause an action to be performed based on the stall event.

According to some implementations, a work machine may include a frame; an implement system coupled to the frame; one or more sensing devices configured to transmit sensing device data relating to an operation of the implement system; and a control unit in communication with the implement system and the one or more sensing devices, the control unit being configured to receive the sensing device data, compare the sensing device data with a stall threshold, initiate a stall timer based on determining that the sensing device data satisfies the stall threshold, the stall timer being configured to measure a stall duration, compare the stall duration with a duration threshold, identify a stall event based on determining that the stall duration satisfies the duration threshold, and cause an action to be performed based on the stall event.

BRIEF DESCRIPTION OF THE DRAWINGS

FIGS. 2A-2C are diagrams of an example implementation of an implement stall detection system described herein.

DETAILED DESCRIPTION

Figure 1:
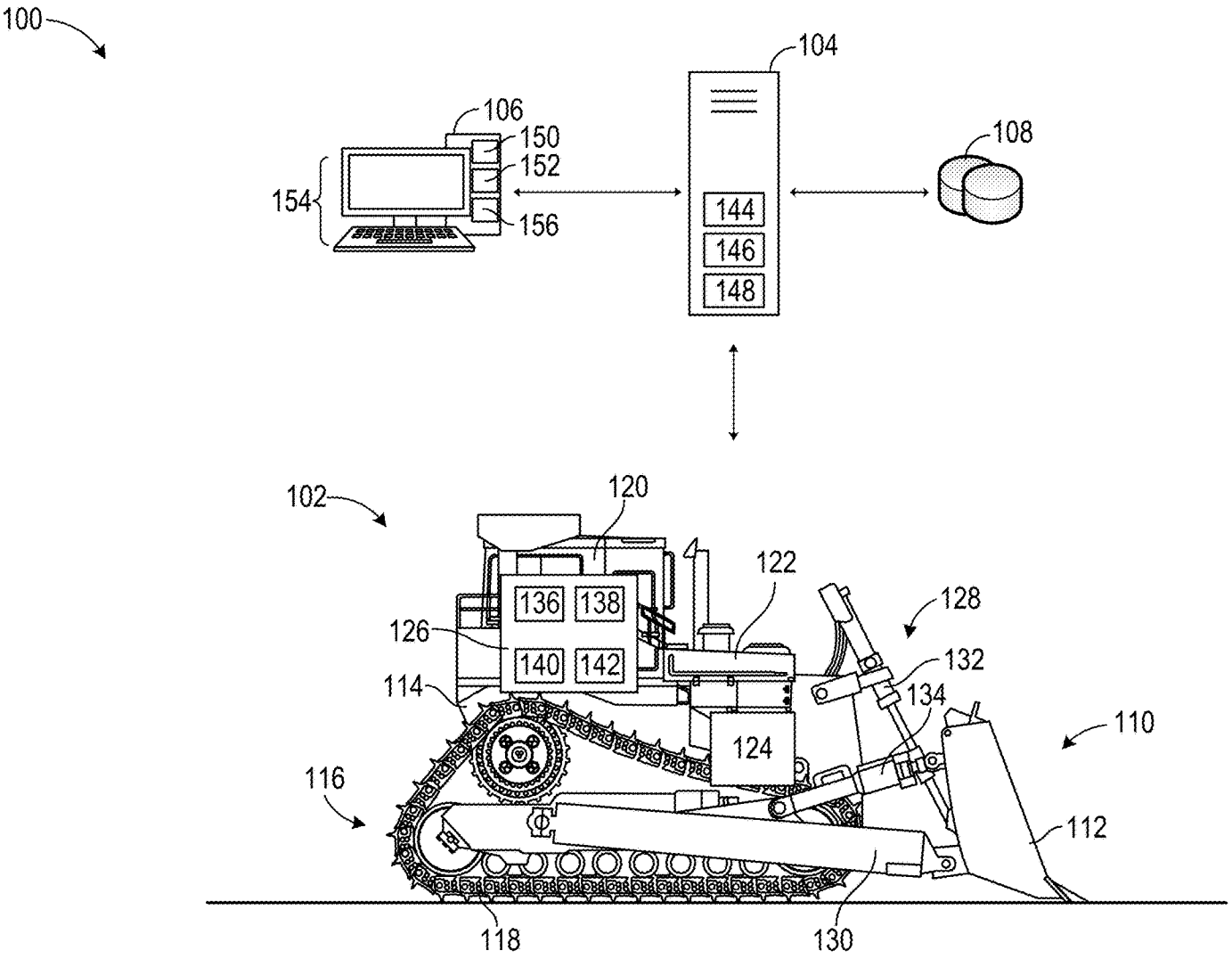
FIG. 1 is a diagram of an example implement stall detection system described herein.

FIG. 1 is a diagram of an example implement stall detection system 100 described herein. As shown in FIG. 1, implement stall detection system 100 may include a work machine 102, a management platform 104, a control station 106, a network storage device 108, and/or another device configured to facilitate operation of work machine 102 within an associated worksite or facility. Work machine 102 (e.g., a dozer, a tractor, a wheel loader, an excavator, and/or the like) may include an implement system 110 that operates an implement 112. Implement stall detection system 100 may be configured to receive implement data relating to implement system 110 of work machine 102, identify a stall event within implement system 110 based on the implement data, and cause one or more actions, based on the stall event, configured to limit and/or correct the stall event. In some examples, implement stall detection system 100 may be used with a single implement system 110 of a single work machine 102, multiple implement systems 110 of a single work machine 102, and/or multiple implement systems 110 of multiple work machines 102.

In some implementations, implement stall detection system 100 may include multiple work machines 102 and/or multiple control stations 106 that interact with management platform 104 and/or network storage device 108. In some examples, implement stall detection system 100 may include multiple management platforms 104 and/or multiple network storage devices 108 that interact with one or more work machines 102 and/or one or more control stations 106. In some examples, implement stall detection system 100 may be used with an autonomously or a semi-autonomously operated work machine 102. For example, implement stall detection system 100 may be used to guide, navigate, and/or control an autonomous or a semi-autonomous work machine 102 based on location data of work machine 102, coordinate data associated with a worksite or a facility associated with work machine 102, coordinate data associated with a target work path and/or a target site plan, and/or the like. In some examples, work machine 102 may receive guidance, navigation, and/or control information from a remote operator via control station 106, from an operator local to work machine 102, and/or from another device of implement stall detection system 100.

As further shown in FIG. 1, work machine 102 includes an implement system 110, an implement 112, a frame 114, an undercarriage 116, traction elements 118, an operator cab 120, an engine 122, one or more sensing devices 124, and a control unit 126. Undercarriage 116 may be coupled to frame 114 and configured to support traction elements 118. Traction elements 118 may include wheels, tracks, and/or the like that are movably coupled to undercarriage 116 and caused to be driven by engine 122. Operator cab 120 may be coupled to frame 114 and configured to support an operator of work machine 102 and one or more components of control unit 126. Engine 122 may include a diesel engine, a gasoline engine, a natural gas engine, a hybrid engine, an electric motor, and/or another power source configured to propel work machine 102. Sensing devices 124 may include sensors, switches, encoders, and/or the like configured to measure, detect, and/or determine hydraulic pressure, pneumatic pressure, valve state, oil temperature, coolant temperature, air temperature, flow rate, a position of implement 112, and/or another operating condition associated with implement system 110. Sensing devices 124 may include a pressure sensing device, a temperature sensing device, a valve state sensing device, a position sensing device, and/or the like. In some examples, sensing devices 124 may include sensors, switches, encoders, and/or the like configured to measure, detect, and/or determine a travel speed, a track speed, a wheel speed, an engine speed, an ambient temperature, an atmospheric pressure, and/or another operating condition associated with work machine 102 that can be used to provide insight relating to operator use of implement system 110 and/or a stall event.

Implement system 110 includes implement 112 and a drive assembly 128. Implement 112 may include a blade, a ripper, a winch, a bucket, a sheer, a hammer, and/or another tool associated with work machine 102. As shown for the example in FIG. 1, drive assembly 128 may include push arms 130, lift cylinders 132, tilt cylinders 134, and/or another component for movably supporting implement 112 relative to work machine 102. For example, push arms 130 may support and pivotally couple implement 112 to frame 114. Lift cylinders 132 may movably couple implement 112 to frame 114 and enable implement 112 to be raised or lowered relative to work machine 102. Tilt cylinders 134 may movably couple implement 112 to frame 114 and enable implement 112 to be tilted relative to work machine 102. Although shown with respect to a track type tractor, drive assembly 128 for another track type tractor or for another type of work machine 102 may be provided in another arrangement (e.g., another arrangement of structures, supports, actuators, cylinders, pumps, valves, motors, and/or the like) that is hydraulically, pneumatically, and/or electrically configured to operate or manipulate implement 112 relative to work machine 102.

Control unit 126 includes a processor 136, a memory 138, a user interface 140, and a communication device 142. Processor 136 is implemented in hardware, firmware, and/or a combination of hardware and software capable of being programmed to perform a function associated with work machine 102 and/or implement system 110. Memory 138 includes a random-access memory (RAM), a read only memory (ROM), and/or another type of dynamic or static storage device that stores information and/or instructions to be performed by processor 136. User interface 140 includes an input device and an output device. The input device may enable an operator of work machine 102 to specify an instruction, a command, and/or another operating parameter for operating work machine 102 and/or implement system 110. The output device may enable an operator of work machine 102 to monitor an operating condition of work machine 102 and/or implement system 110, a progress of an operation, monitor a performance of an operation, track a location of work machine 102, track a location of another work machine 102, access historic events associated with work machine 102, access a visual model and/or a map of a worksite or a facility, access a visual model and/or a map of a target work path and/or a target site plan, and/or the like.

Communication device 142 includes a wireless local area network (WLAN) component (e.g., a Wi-Fi component), a radio frequency (RF) communication component (e.g., a Bluetooth component), a positioning component (e.g., a global positioning system (GPS) component, a global navigation satellite system (GNSS) component), and/or the like. Communication device 142 may enable communication between work machine 102, management platform 104, control station 106, network storage device 108, and/or another device. For example, communication device 142 may enable processor 136 to receive implement data relating to implement system 110 (e.g., from management platform 104 and/or control station 106), and/or transmit implement data relating to implement system 110 (e.g., to management platform 104, control station 106, and/or network storage device 108). In some examples, communication device 142 may enable processor 136 to exchange location data and/or coordinate data relating to work machine 102, a worksite, a facility, a target work path, a target site plan, and/or the like with management platform 104, control station 106, and/or network storage device 108. In some examples, control unit 126 may communicate with control station 106 and/or network storage device 108 directly and/or indirectly via management platform 104.

In some implementations, control unit 126 may receive implement data relating to implement system 110 of work machine 102, compare the implement data with a stall threshold, initiate a stall timer to measure a stall duration based on determining that the implement data satisfies the stall threshold, compare the stall duration with a duration threshold, identify a stall event based on determining that the stall duration satisfies the duration threshold, and cause an action to be performed based on the stall event. The implement data may include sensing device data relating to an operating condition of implement system 110 (e.g., provided via sensing devices 124), control data relating to an operating parameter of implement system 110 (e.g., provided via user interface 140), and/or the like. The sensing device data may include information relating to a pressure, a temperature, a valve state, a position of implement 112, and/or another operating condition associated with implement system 110. In some examples, sensing device data may include a travel speed, a track speed, a wheel speed, an engine speed, an ambient temperature, an atmospheric pressure, and/or another operating condition associated with work machine 102 that can be used to provide additional insight relating to operator use of implement system 110 and/or a stall event. The control data may include information relating to an input command for operating implement system 110. The stall threshold may include a pressure threshold, a temperature threshold, a valve state threshold, a position threshold, a control threshold, and/or another threshold associated with implement system 110.

In some implementations, if a stall event is identified, control unit 126 may provide a notification to an operator to correct the stall event (e.g., a visual, an audible, and/or a haptic indication that implement system 110 is stalling, an instruction for correcting the stall event, and/or the like), adjust a control signal for operating implement system 110 to correct the stall event, and/or cause another action to be performed to correct the stall event. In some examples, control unit 126 may compare the stall duration with a plurality of duration thresholds, and determine the action to be performed based on a particular one of the duration thresholds that is satisfied by the stall duration. For example, if the stall duration satisfies a first duration threshold, control unit 126 may provide the notification to the operator. If the stall duration satisfies a second duration threshold that is longer in duration than the first duration threshold (e.g., if the notification was not effective in correcting the stall event), control unit 126 may adjust the control signal for operating implement system 110, to correct the stall event. One or more functions described as being performed by control unit 126 may be performed by management platform 104, control station 106, and/or network storage device 108. Furthermore, one or more functions described as being performed by control unit 126 may be selectively enabled and/or disabled based on operator input, manufacturer design or specification, and/or the like.

As further shown in FIG. 1, management platform 104 includes a processor 144, a memory 146, and a communication device 148. Processor 144 is implemented in hardware, firmware, and/or a combination of hardware and software capable of being programmed to perform a function associated with work machine 102 and/or implement system 110. Memory 146 includes a RAM, a ROM, and/or another type of dynamic or static storage device that stores information and/or instructions to be performed by processor 144. Communication device 148 includes a WLAN component, an RF communication component, a positioning component, and/or the like. Communication device 148 may enable processor 144 to receive implement data relating to implement system 110 (e.g., from work machine 102 and/or control station 106), and/or transmit implement data (e.g., to work machine 102, control station 106, and/or network storage device 108). In some examples, communication device 148 may enable processor 144 to exchange location data and/or coordinate data relating to work machine 102, a worksite, a facility, a target work path, a target site plan, and/or the like with work machine 102, control station 106, and/or network storage device 108.

In some implementations, management platform 104 may receive implement data relating to implement system 110 of work machine 102, compare the implement data with a stall threshold, initiate a stall timer to measure a stall duration based on determining that the implement data satisfies the stall threshold, compare the stall duration with a duration threshold, identify a stall event based on determining that the stall duration satisfies the duration threshold, and cause an action to be performed based on the stall event. The implement data may include sensing device data relating to an operating condition of implement system 110 (e.g., provided via sensing devices 124 of work machine 102), control data relating to an operating parameter of implement system 110 (e.g., provided via work machine 102 and/or control station 106), and/or the like.

In some implementations, if a stall event is identified, management platform 104 may provide a notification to an operator to correct the stall event, adjust a control signal for operating implement system 110 to correct the stall event, and/or cause another action to be performed to correct the stall event. In some examples, management platform 104 may compare the stall duration with a plurality of duration thresholds, and determine the action to be performed based on a particular one of the duration thresholds that is satisfied by the stall duration. For example, management platform 104 may provide the notification to the operator if the stall duration satisfies a first duration threshold, and adjust the control signal for operating implement system 110 to correct the stall event if the stall duration satisfies a second duration threshold that is longer in duration than the first duration threshold (e.g., if the notification was not effective and the stall event persists). One or more functions described as being performed by management platform 104 may be performed by control unit 126 of work machine 102, control station 106, and/or network storage device 108.

As further shown in FIG. 1, control station 106 includes a processor 150, a memory 152, a user interface 154, and a communication device 156. Processor 150 is implemented in hardware, firmware, and/or a combination of hardware and software capable of being programmed to perform a function associated with work machine 102 and/or implement system 110. Memory 152 includes a RAM, a ROM, and/or another type of dynamic or static storage device that stores information and/or instructions to be performed by processor 150. User interface 154 includes an input device and an output device. The input device may enable an operator of work machine 102 to specify an instruction, a command, and/or another parameter for operating work machine 102 and/or implement system 110. The output device may enable an operator of work machine 102 to monitor a progress of an operation, monitor a performance of an operation, track a location of work machine 102, track a location of another work machine 102, access historic events associated with work machine 102, access a visual model and/or a map of a worksite or a facility, access a visual model and/or a map of a target work path and/or a target site plan, and/or the like.

Communication device 156 includes a WLAN component, an RF communication component, a positioning component, and/or the like. Communication device 156 may enable processor 150 to receive implement data relating to implement system 110 (e.g., from work machine 102 and/or control station 106), and/or transmit implement data relating to implement system 110 (e.g., to work machine 102, management platform 104, and/or network storage device 108). In some examples, communication device 156 may enable processor 150 to exchange location data and/or coordinate data relating to work machine 102, a worksite, a facility, a target work path, a target site plan, and/or the like with work machine 102, management platform 104, and/or network storage device 108. In some examples, control station 106 may communicate with work machine 102 and/or network storage device 108 directly and/or indirectly via management platform 104. Additionally, or alternatively, control station 106 may serve as a user interface of management platform 104.

In some implementations, control station 106 may receive implement data relating to implement system 110 of work machine 102, compare the implement data with a stall threshold, initiate a stall timer to measure a stall duration based on determining that the implement data satisfies the stall threshold, compare the stall duration with a duration threshold, identify a stall event based on determining that the stall duration satisfies the duration threshold, and cause an action to be performed based on the stall event. The implement data may include sensing device data relating to an operating condition of implement system 110 (e.g., provided via sensing devices 124 of work machine 102), control data relating to an operating parameter of implement system 110 (e.g., provided via work machine 102 and/or management platform 104), and/or the like.

In some implementations, if a stall event is identified, control station 106 may provide a notification to an operator to correct the stall event, adjust a control signal for operating implement system 110 to correct the stall event, and/or cause another action to be performed to correct the stall event. In some examples, control station 106 may compare the stall duration with a plurality of duration thresholds, and determine the action to be performed based on a particular one of the duration thresholds that is satisfied by the stall duration. For example, control station 106 may provide the notification to the operator if the stall duration satisfies a first duration threshold, and adjust the control signal for operating implement system 110 to correct the stall event if the stall duration satisfies a second duration threshold that is longer in duration than the first duration threshold (e.g., if the notification was not effective and the stall event persists). One or more functions described as being performed by control station 106 may be performed by control unit 126 of work machine 102, management platform 104, and/or network storage device 108.

As indicated above, FIG. 1 is provided as an example. Other examples may differ from what was described in connection with FIG. 1.

FIGS. 2A-2C are diagrams of an example implementation 200 of implement stall detection system 100 described herein. As shown in FIG. 2A, and by reference number 202, control unit 126, management platform 104, and/or control station 106 may receive implement data (e.g., Sensing Device Data and/or Control Data) relating to implement system 110 of work machine 102. The implement data may include sensing device data relating to an operating condition of implement system 110 (e.g., provided via sensing devices 124) and/or control data relating to an operating parameter of implement system 110 (e.g., provided via user interface 140 of work machine 102, management platform 104, and/or user interface 154 of control station 106), and/or the like. The sensing device data may include information relating to a pressure, a temperature, a valve state, a position of implement 112, and/or another operating condition associated with implement system 110. The control data may include information relating to an input command for operating a position, a motion, a force, a power output, an action, and/or another operating parameter of implement system 110 that is requested by an operator.

As further shown in FIG. 2A, and by reference number 202, control unit 126, management platform 104, and/or control station 106 may compare the implement data with one or more stall thresholds (e.g., Stall Threshold n) associated with implement system 110. For example, control unit 126, management platform 104, and/or control station 106 may compare sensing device data relating to oil temperature of implement system 110 with a stall threshold relating to an oil temperature rating of implement system 110, and/or compare control data relating to a motion of implement 112 requested by the operator with a stall threshold relating to a range of capable motion of implement system 110. The stall thresholds may be preprogrammed in memory 138 of work machine 102, memory 146 of management platform 104, memory 152 of control station, and/or network storage device 108. In some examples, the stall thresholds may be fixed and/or dynamically adjusted based on an operating condition of work machine 102 and/or the like.

As shown in FIG. 2B, and by reference number 204, control unit 126, management platform 104, and/or control station 106 may initiate a stall timer to measure a stall duration (e.g., Stall Timer Value) based on determining that the implement data (e.g., Sensing Device Data 2) satisfies one or more of the stall thresholds (e.g., Stall Threshold 4). In some examples, control unit 126, management platform 104, and/or control station 106 may be configured to initiate the stall timer if any one of the stall thresholds is satisfied by the implement data. Additionally, or alternatively, control unit 126, management platform 104, and/or control station 106 may be configured to initiate the stall timer based on determining that the implement data satisfies a particular number of stall thresholds and/or based on determining that the implement data satisfies a particular combination of stall thresholds. In some examples, control unit 126, management platform 104, and/or control station 106 may be configured to initiate the stall timer based on a corroboration between the stall thresholds satisfied by the sensing device data and the stall thresholds satisfied by the control data.

As further shown in FIG. 2B, and by reference number 204, control unit 126, management platform 104, and/or control station 106 may compare the stall duration with one or more duration thresholds, and identify a stall event based on determining that the stall duration (e.g., Stall Timer Value) satisfies one or more of the duration thresholds (e.g., Duration Threshold 2). The duration thresholds may be configured to determine if the stall duration corresponds to a stall event (e.g., a stall event that poses a risk of wear or damage to implement system 110, drive assembly 128, and/or another component of work machine 102). In some examples, the duration thresholds may be tiered, to qualify the risk that the stall event poses to implement system 110. For example, satisfaction of a first duration threshold (e.g., Duration Threshold 1) may indicate onset of a stall event that poses a nominal risk, satisfaction of a second duration threshold (e.g., Duration Threshold 2) that is longer in duration than the first duration threshold may indicate a prolonged stall event that poses a significant risk, and satisfaction of a third duration threshold (e.g., Duration Threshold 3) that is longer in duration than the first duration threshold and the second duration threshold may indicate onset of potential damage to implement system 110.

As shown in FIG. 2C, and by reference number 206, control unit 126, management platform 104, and/or control station 106 may cause an action to be performed to correct the stall event. In some examples, control unit 126, management platform 104, and/or control station 106 may provide a notification to an operator to correct the stall event. For example, control unit 126, management platform 104, and/or control station 106 may generate a notification (e.g., a visual, an audible, and/or a haptic indication of the stall event, an instruction for correcting the stall event, and/or the like), and provide the notification to the operator via user interface 140 of work machine 102 and/or user interface 154 of control station 106. In some examples, control unit 126, management platform 104, and/or control station 106 may adjust a control signal for operating implement system 110 to correct the stall event. For example, control unit 126, management platform 104, and/or control station 106 may temporarily override input commands provided by the operator, and control implement system 110 to restore the implement data to acceptable levels. In some examples, control unit 126, management platform 104, and/or control station 106 may temporarily shut down implement system 110 and/or work machine 102 to prevent further wear or damage.

In some implementations, control unit 126, management platform 104, and/or control station 106 may determine the action to be performed based on the duration threshold satisfied by the stall duration. For example, a first duration threshold (e.g., Duration Threshold 1) may correspond to a first action (e.g., Action 1) that provides a notification to the operator to correct the stall event, a second duration threshold (e.g., Duration Threshold 2) may correspond to a second action (e.g., Action 2) that adjusts a control signal to correct the stall event, and a third duration threshold (e.g., Duration Threshold 3) may correspond to a third action (e.g., Action 3) that temporarily shuts down implement system 110 and/or work machine 102. As shown for the example in FIG. 2C, based on the duration threshold (e.g., Duration Threshold 2) that was satisfied by the stall duration (e.g., Stall Timer Value), control unit 126, management platform 104, and/or control station 106 may qualify the stall event with a warning level (e.g., Warning Level 2), and cause an action (e.g., Action 2) that adjusts the control signals for operating implement system 110 to correct the stall event.

In some implementations, control unit 126, management platform 104, and/or control station 106 may cause a different combination of actions to be performed according to a different combination of duration thresholds. For example, control unit 126, management platform 104, and/or control station 106 may adjust the control signal for operating implement system 110 based on satisfaction of the first duration threshold, and/or provide the notification to the operator based on satisfaction of the second duration threshold. In some examples, control unit 126, management platform 104, and/or control station 106 may cause a plurality of actions (e.g., provide the notification and adjust the control signal) based on satisfaction of a single duration threshold. In some examples, control unit 126, management platform 104, and/or control station 106 may repeat or sustain an action (e.g., provide the notification to the operator) for a plurality of duration thresholds. In some examples, control unit 126, management platform 104, and/or control station 106 may provide the notification to the operator based on satisfaction of the first duration threshold, provide another notification based on satisfaction of the second duration, and adjust the control signal to correct the stall event based on satisfaction of the third duration threshold.

In some implementations, control unit 126, management platform 104, and/or control station 106 may monitor the implement data during the stall duration (e.g., intermittently, periodically, and/or continuously in real-time) to determine whether the stall event has been corrected (e.g., the implement data no longer satisfies the stall threshold). If the implement data indicates that the stall event has been corrected, control unit 126, management platform 104, and/or control station 106 may reset the stall timer and/or cease the action used to correct the stall event. In some examples, control unit 126, management platform 104, and/or control station 106 may use a single stall timer that is initiated if the implement data satisfies the stall threshold and continue timing the stall duration until the stall event has been corrected. In some examples, such as when a plurality of duration thresholds is used, control unit 126, management platform 104, and/or control station 106 may use a single stall timer that is reset and restarted upon satisfaction of the respective duration thresholds. In some examples, control unit 126, management platform 104, and/or control station 106 may use a plurality of stall timers to measure the stall duration in relation to a plurality of duration thresholds.

In some implementations, if a stall event is identified, control unit 126, management platform 104, and/or control station 106 may generate a stall event entry based on the stall event and update a data log associated with work machine 102 with the stall event entry. Additionally, or alternatively, control unit 126, management platform 104, and/or control station 106 may generate a record based on the stall event and transmit the record to a network storage device to be stored in connection with work machine 102. In some examples, the record may include information relating to the stall event, the stall duration, the implement data (e.g., the sensing device data and/or the control data that triggered the stall event), the stall threshold that was satisfied by the impalement data, a time of the stall event, a location of the stall event, a warning level of the stall event, an identification (e.g., a model type, a model name, a model number, a serial number, an identification number, and/or another identifier) of work machine 102, a runtime of work machine 102 (e.g., an average daily runtime, an average monthly runtime, an average yearly runtime, a number of hours work machine 102 was in operation prior to the stall event, during the stall event, and/or after the stall event, and/or the like), an identification of an operator of work machine 102, and/or the like.

In some implementations, the record may include additional insight relating to operator use of implement system 110 and/or the stall event. For example, the record may include insight and/or an operating condition of work machine 102 for a duration of time (e.g., 30 seconds and/or the like) leading up to the stall event, a duration of time (e.g., 5 seconds and/or the like) after the stall event, and/or another timeframe associated with the stall event. In some examples, control unit 126, management platform 104, and/or control station 106 may cause a different action or a different set of actions to be performed in response to satisfaction of a different threshold or a different set of thresholds.

As indicated above, FIGS. 2A-2C are provided as an example. Other examples may differ from what is described in connection with FIGS. 2A-2C.

Figure 3:
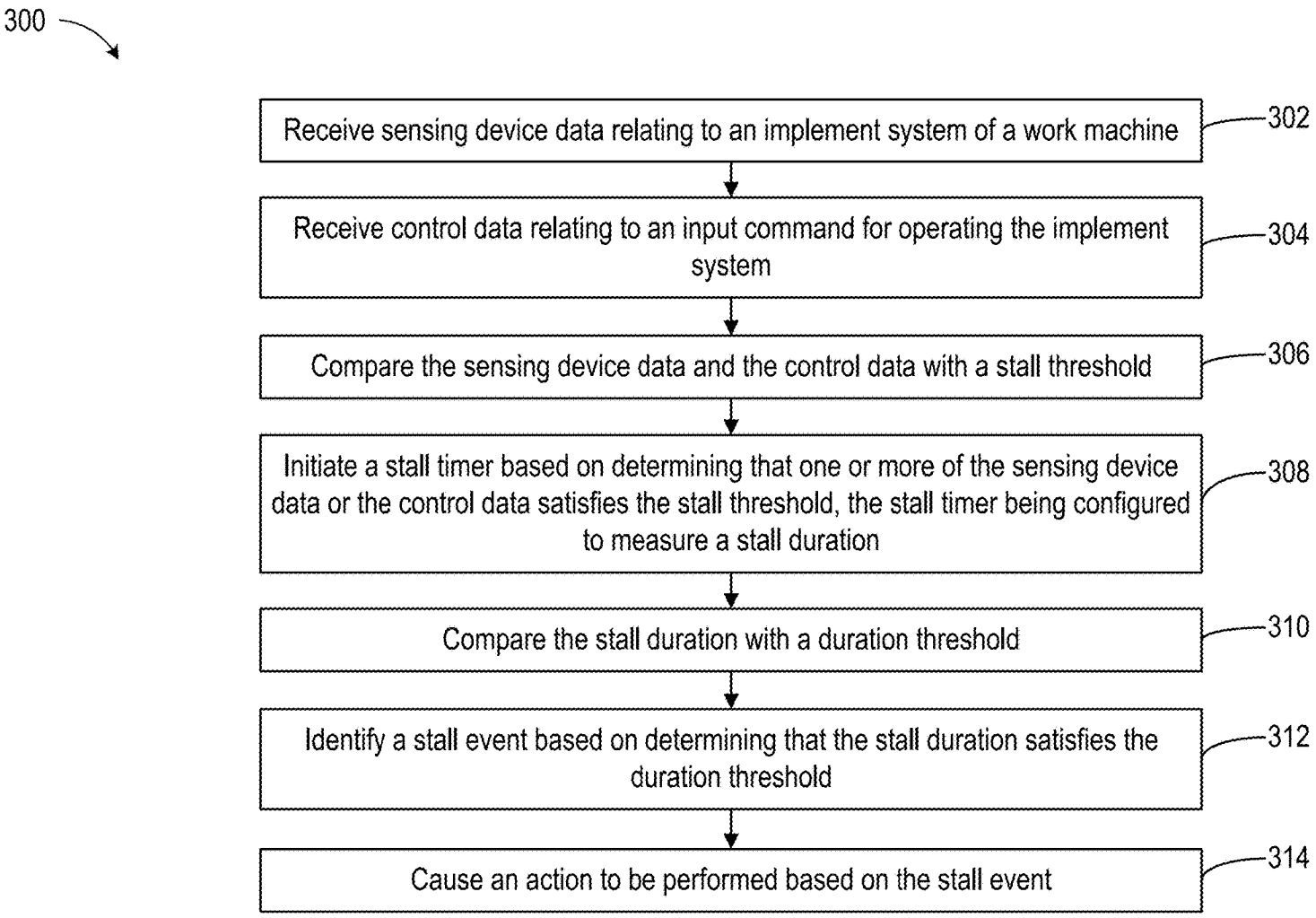
FIG. 3 is a flow chart of an example process for detecting an implement stall event.

FIG. 3 is a flow chart of an example process 300 for detecting an implement stall event. One or more process blocks of FIG. 3 may be performed by a control unit of a work machine (e.g., control unit 126 of work machine 102) and/or by another component or a group of components separate from or including the control unit (e.g., management platform 104, control station 106, network storage device 108, and/or another device of implement stall detection system 100).

As shown in FIG. 3, process 300 may include receiving sensing device data relating to an implement system of a work machine (block 302). For example, the control unit (e.g., using processor 136, memory 138, user interface 140, communication device 142, and/or the like) may receive sensing device data relating to an implement system of a work machine, as described above.

As further shown in FIG. 3, process 300 may include receiving control data relating to an input command for operating the implement system (block 304). For example, the control unit (e.g., using processor 136, memory 138, user interface 140, communication device 142, and/or the like) may receive control data relating to an input command for operating the implement system, as described above.

As further shown in FIG. 3, process 300 may include comparing the sensing device data and the control data with a stall threshold (block 306). For example, the control unit (e.g., using processor 136, memory 138, user interface 140, communication device 142, and/or the like) may compare the sensing device data and the control data with a stall threshold, as described above.

As further shown in FIG. 3, process 300 may include initiating a stall timer based on determining that one or more of the sensing device data or the control data satisfy the stall threshold, the stall timer being configured to measure a stall duration (block 308). For example, the control unit (e.g., using processor 136, memory 138, user interface 140, communication device 142, and/or the like) may initiate a stall timer based on determining that one or more of the sensing device data or the control data satisfy the stall threshold, as described above. The stall timer may be configured to measure a stall duration.

As further shown in FIG. 3, process 300 may include comparing the stall duration with a duration threshold (block 310). For example, the control unit (e.g., using processor 136, memory 138, user interface 140, communication device 142, and/or the like) may compare the stall duration with a duration threshold, as described above.

As further shown in FIG. 3, process 300 may include identifying a stall event based on determining that the stall duration satisfies the duration threshold (block 312). For example, the control unit (e.g., using processor 136, memory 138, user interface 140, communication device 142, and/or the like) may identify a stall event based on determining that the stall duration satisfies the duration threshold, as described above.

As further shown in FIG. 3, process 300 may include causing an action to be performed based on the stall event (block 314). For example, the control unit (e.g., using processor 136, memory 138, user interface 140, communication device 142, and/or the like) may cause an action to be performed based on the stall event, as described above.

Process 300 may include variations and/or additional implementations to those described in connection with FIG. 3, such as any single implementation or any combination of implementations described elsewhere herein. Although FIG. 3 shows example blocks of process 300, in some examples, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

A work machine (e.g., a dozer, a tractor, a wheel loader, an excavator, and/or the like) may be provided with an implement system. The implement system may include an implement and a drive assembly that may be hydraulically, pneumatically, and/or electrically operated to manipulate the implement. In particular, the implement system may receive one or more input commands indicative of a desired position, movement, and/or action of the implement from an operator, and use the drive assembly to raise, tilt, rotate, and/or otherwise manipulate the implement according to the input commands. In some cases, the implement system may stall, such as when an input command provided by an operator overloads a component of the drive assembly of the implement system or otherwise controls the implement system to a maximum capability of the drive assembly. Prolonged and/or frequent stall events can raise component temperatures, pressures, and/or other operating parameters beyond acceptable thresholds and accelerate wear of the implement system and/or the work machine.

An implement stall detection system described herein enables monitoring of implement stall events and prevention of prolonged and/or frequent stall events. For example, the implement stall detection system may detect a stall event based on implement data (e.g., implement control data and/or sensing device data) and one or more corresponding stall thresholds, use a stall timer to measure a duration of the stall event, and cause one or more actions based on the stall event and the duration of the stall event. In some examples, the implement stall detection system may notify an operator of the work machine of the stall event and/or provide the operator with an instruction for correcting the stall event. In some examples, the implement stall detection system may autonomously or semi-autonomously adjust a control signal for operating the implement system in order to correct the stall event. In some examples, the implement stall detection system may update a data log associated with the work machine with a stall event entry based on the stall event, and/or generate a record of the stall event to be stored in a network storage device.

Accordingly, the implement stall detection system described herein may be used to limit wear or damage of a drive assembly of an implement system caused by prolonged and/or frequent stall events and preserve utility of an associated work machine. For instance, by providing warning notifications of a stall event to an operator and/or overriding improper operator input, the implement stall detection system may be able to actively limit a duration of the stall event to safer or more acceptable durations. Additionally, by providing notifications with an instruction for correcting a stall event, the implement stall detection system may be used to train operators that are unaccustomed to the work machine. Furthermore, by recording or tracking stall events in data logs, the implement stall detection system enables more precise monitoring of operator performance and more effective operator coaching. The implement stall detection system may thereby prevent premature failure of the implement system, limit wear or damage to other components of the work machine that may otherwise be affected by premature failure of the implement system, and reduce downtime.

What is claimed is:

1. A method, comprising:

receiving, by a device, implement data relating to an implement system of a work machine;

comparing, by the device, the implement data with a stall threshold;

initiating, by the device, a stall timer based on determining that the implement data satisfies the stall threshold, the stall timer being configured to measure a stall duration;

comparing, by the device, the stall duration with a first duration threshold and a second duration threshold, the second duration threshold being longer in duration than the first duration threshold;

identifying, by the device, a stall event based on determining that the stall duration satisfies at least one of the first duration threshold or the second duration threshold;

selectively causing, by the device, at least one of a first action or a second action to be performed based on the stall event, the first action being performed based on determining that the stall duration satisfies the first duration threshold, or the second action being performed based on determining that the stall duration satisfies the first duration threshold and the second duration threshold;

generating a stall event entry based on the stall event; and updating, with the stall event entry, a data log associated with the work machine.

2. The method of claim 1, wherein receiving the implement data comprises:

receiving, from a sensing device, sensing device data relating to an operation of the implement system; and receiving, from a user interface, control data relating to the operation of the implement system.

3. The method of claim 1, wherein receiving the implement data comprises:

receiving, from a sensing device, sensing device data relating to an operation of the implement system, the sensing device data including information relating to one or more of a pressure, a temperature, or a valve state associated with the implement system.

4. The method of claim 1, wherein receiving the implement data comprises:

receiving control data relating to an operation of the implement system, the control data including information relating to an input command for operating the implement system.

5. The method of claim 1, wherein the stall threshold includes one or more of a pressure threshold, a temperature threshold, a valve state threshold, or a control threshold associated with the implement system.

6. The method of claim 1, wherein the first action includes providing a notification to an operator to correct the stall event, and wherein the second action includes adjusting a control signal for operating the implement system to correct the stall event.

7. The method of claim 1, further comprising:

generating a record based on the stall event, the record including information relating to one or more of the stall event, the stall duration, the implement data, a time of the stall event, a location of the stall event, a warning level of the stall event, an identification of the work machine, a runtime of the work machine, or an identification of an operator of the work machine; and transmitting the record to a network storage device associated with the work machine.

8. A device, comprising:

one or more memories; and one or more processors, communicatively coupled to the one or more memories, configured to:

receive sensing device data relating to an implement system of a work machine;

receive control data relating to an input command for operating the implement system;

compare the sensing device data and the control data with a stall threshold;

initiate a stall timer based on determining that one or more of the sensing device data or the control data satisfies the stall threshold, the stall timer being configured to measure a stall duration;

compare the stall duration with a duration threshold;

identify a stall event based on determining that the stall duration satisfies the duration threshold; and cause an action to be performed based on the stall event, such that when causing the action to be performed:

generate a stall event entry based on the stall event; and update, with the stall event entry, a data log associated with the work machine.

9. The device of claim 8, wherein the one or more processors are configured to, when receiving the sensing device data:

receive, from a sensing device, the sensing device data relating to one or more of a pressure, a temperature, or a valve state associated with the implement system.

10. The device of claim 8, wherein the stall threshold includes one or more of a pressure threshold, a temperature threshold, a valve state threshold, or a control threshold associated with the implement system.

11. The device of claim 8, wherein the one or more processors are configured to, when causing the action to be performed:

generate a record based on the stall event, the record including information relating to one or more of the stall event, the stall duration, the sensing device data, the control data, a time of the stall event, a location of the stall event, a warning level of the stall event, an identification of the work machine, a runtime of the work machine, or an identification of an operator of the work machine; and transmit the record to a network storage device associated with the work machine.

12. A work machine, comprising:

a frame;

an implement system coupled to the frame;

one or more sensing devices configured to transmit sensing device data relating to an operation of the implement system; and a control unit in communication with the implement system and the one or more sensing devices, the control unit being configured to:

receive the sensing device data, compare the sensing device data with a stall threshold, initiate a stall timer based on determining that the sensing device data satisfies the stall threshold, the stall timer being configured to measure a stall duration, compare the stall duration with a duration threshold, identify a stall event based on determining that the stall duration satisfies the duration threshold, and cause an action to be performed based on the stall event, such that when causing the action to be performed:

generate a record based on the stall event, the record including information relating to one or more of the stall event, the stall duration, the sensing device data, a time of the stall event, a location of the stall event, a warning level of the stall event, an identification of the work machine, a runtime of the work machine, or an identification of an operator of the work machine, and transmit the record to a network storage device associated with the work machine.

13. The work machine of claim 12, wherein the one or more sensing devices include one or more of a pressure sensing device, a temperature sensing device, or a valve state sensing device associated with the implement system.

14. The work machine of claim 12, wherein the stall threshold includes one or more of a pressure threshold, a temperature threshold, or a valve state threshold associated with the implement system.

15. The work machine of claim 12, wherein the control unit is configured to, when causing the action to be performed:

adjust a control signal for operating the implement system to correct the stall event.

16. The work machine of claim 12, further comprising an operator cab having a user interface, wherein the control unit is configured to, when causing the action to be performed:

generate a notification based on the stall event, the notification including information for correcting the stall event, and communicate the notification to the user interface.

17. The work machine of claim 12, wherein the control unit is further configured to:

receive control data relating to an input command for operating the implement system, compare the control data with a control threshold, and initiate the stall timer based on determining that the control data satisfies the control threshold.

* * * * *